United States Patent [19]

Colley

[11] Patent Number: 4,896,886

[45] Date of Patent: Jan. 30, 1990

[54] PORTABLE GOLF PUTTING APPARATUS

[76] Inventor: Russell H. Colley, 7446 Dublin Dr., Boca Raton, Fla. 33433

[21] Appl. No.: 304,219

[22] Filed: Jan. 31, 1989

[51] Int. Cl.[4] ..... A63B 69/36

[52] U.S. Cl. ..... 273/184 A; 273/177 A; 273/176 F; 273/176 J

[58] Field of Search ..... 273/184 A, 185 R, 177 R, 273/177 A, 177 B, 178 R, 178 A, 178 B, 179 R, 179 A, 179 B, 179 C, 179 D, 179 E, 180, 176 F, 176 J

[56] References Cited

U.S. PATENT DOCUMENTS

| | | | |
|---|---|---|---|
| 1,208,838 | 12/1916 | Rolfe | 273/177 A |
| 3,507,499 | 4/1970 | Rice | 273/178 R |
| 3,909,007 | 9/1975 | Wuertemburg et al. | 273/177 A |

FOREIGN PATENT DOCUMENTS

| | | | |
|---|---|---|---|
| 504628 | 4/1939 | United Kingdom | 273/177 R |

*Primary Examiner*—George J. Marlo
*Attorney, Agent, or Firm*—Alvin S. Blum

[57] ABSTRACT

A portable golf putting apparatus includes a simulated grass carpet that can be rolled up in compact sections without interference from any cups. The carpet is unrolled and sections joined together with flat seams that do not interfere with smooth rolling of the ball. Cups are installed at selected locations on the carpet surface. The cups simulate holes in the green by their action but they do not actually descend below the carpet. Each cup includes a central post that attaches to the carpet. An inverted cup housing is held on the post suspended over the carpet surface. Hanging from the perimeter of the housing are many pivotted elements that extend down to a point where they will be contacted by a ball entering the cup area. They pivot inward with the ball but prevent the ball from rolling out, thereby simulating the ball dropping into a real cup.

20 Claims, 5 Drawing Sheets

FIG. 7
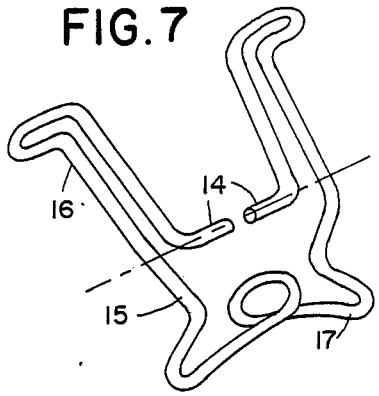
FIG. 6
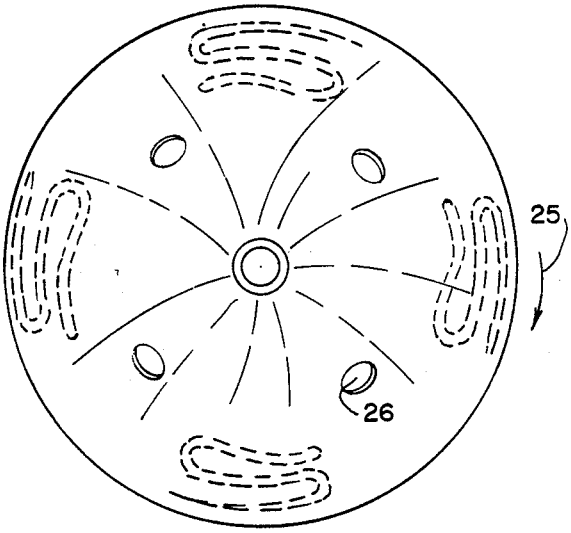
FIG. 11
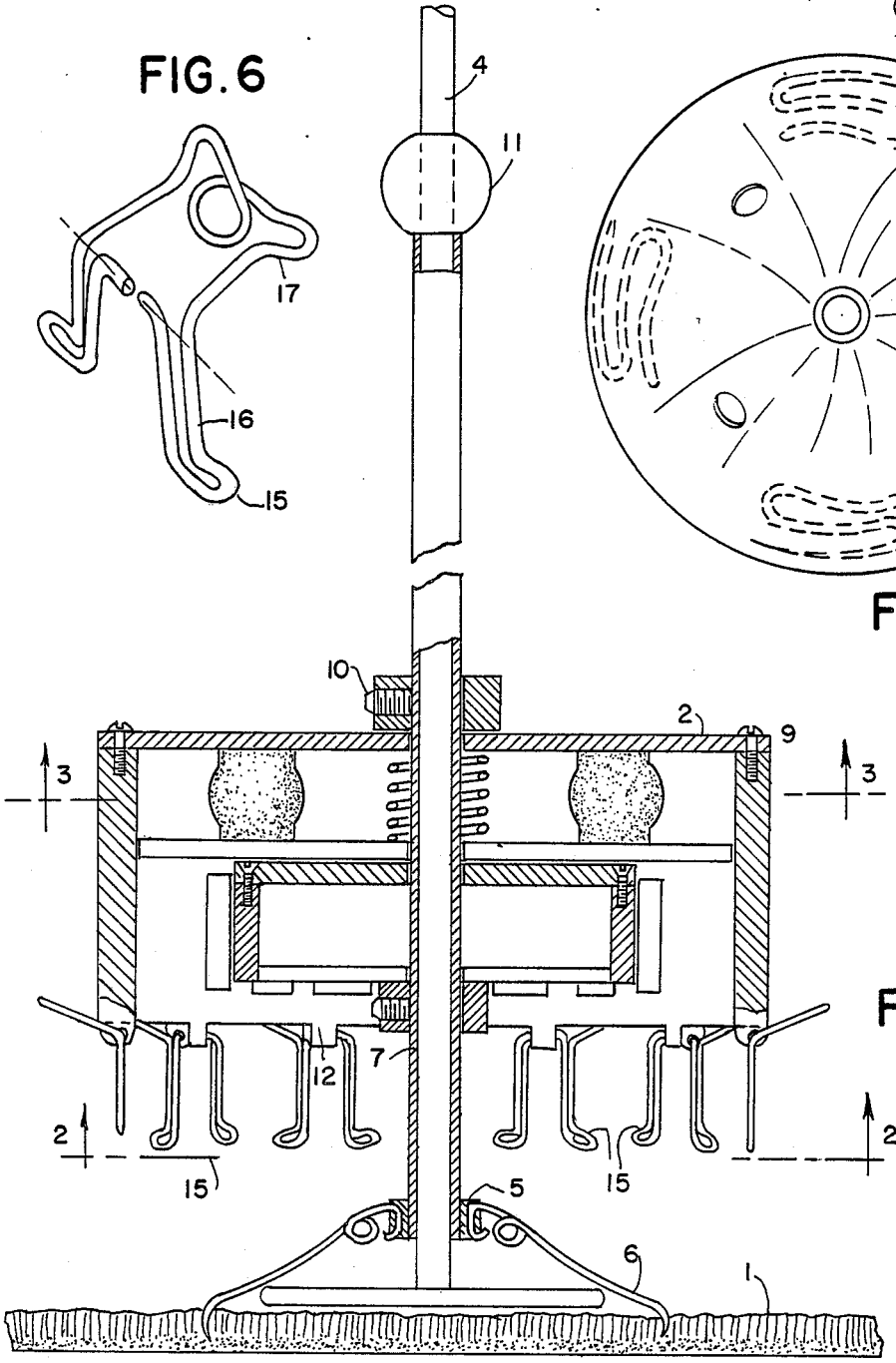
FIG. 1

FIG. 8
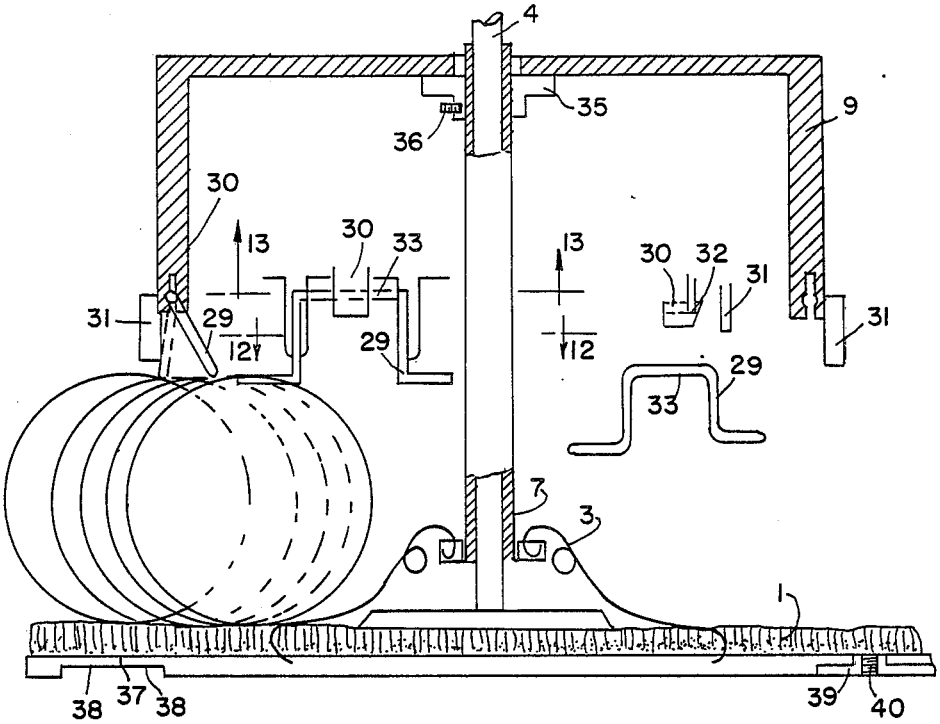
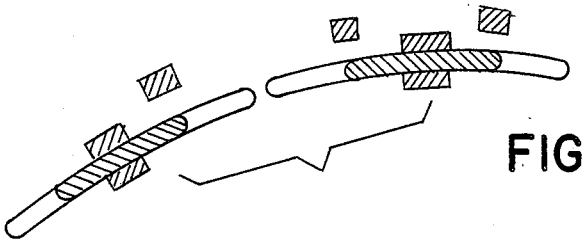
FIG. 13
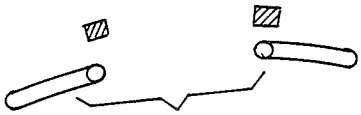
FIG. 12

PORTABLE GOLF PUTTING APPARATUS

This invention relates to the putting portion of the game of golf and more particularly to portable putting greens that may be rolled up for transport with "holes" that do not extend below the putting green surface but simulate the operation of true holes in the putting green.

BACKGROUND OF THE INVENTION

To be successful in the game of golf, one must be skilled in putting. Many hotels and recreational areas have putting greens so that golfers may sharpen their skills by practice as well as enjoying playing this portion of the game. However, maintenance is costly, and the area is useful only when weather permits. There have been many inventions devoted to providing practice putting such as thick grass-simulating panels with holes or cups deep enough to hold the ball. These are quite bulky to transport and are not readily removable to provide alternative uses for the area. Other devices include holes that are elevated on an incline that does not simulate real putting situations because excessive force is required to raise the ball when it reaches the hole.

SUMMARY OF THE INVENTION

It is accordingly an object of the invention to provide a portable putting green or turf that is substantially a thin flat flexible carpet-like material that may be rolled up for transport and storage and in which the "holes" or cups do not substantially increase the thickness of the carpet when ready for transport. It is yet another object that the holes be easily attached and removed from the putting surface for varying hole location and for preparation for transport. It is yet another object that the cups be such as to simulate the operation of a regular golf hole without requiring any extra force or permitting a ball to pass in one side of the cup and out the other if hit forcefully, i.e. the ball must be trapped just as if it had fallen down a real hole. The putting green must further be provided with seam joining means to permit the division of the green into segments small enough to be transported and stored yet joined together with seams that do not affect the ball's movement.

The apparatus of the invention includes a flexible simulated grass-carpet, with seams easily separated and joined closely enough and flat enough to not affect the movement of the ball. The cups of the apparatus are individually removable and attachable to the carpet. The cup is actually a device with a central member that attaches to the carpet surface and an inverted cup suspended by the central member over the carpet high enough to admit the ball. Hanging from the rim of the cup are a plurality of pivotally attached, catching members that are pushed aside when a ball rolls into the area that would be the hole in a real green the "cup area". These catching members are pushed aside by so little force that they do not affect the normal movement of the ball. However, once the ball has reached the cup area, the catching members prevent the ball from leaving. The catching members completely encircle the cup rim so that the effect is the same as hitting a ball into a real hole from any angle. The attaching means for attaching the cup to the carpet are such that the cup may be readily removed for rolling up the carpet and reattached for play any number of times without damage to the apparatus. Consequently, any area that may be used for dining, dancing or any other purpose in home or hotel, etc. may be readily converted to a putting green without special skills or effort.

These and other objects, advantages and features of the invention will become more fully apparent when the following detailed description of the preferred embodiment of the invention is read in conjunction with the accompanying drawings.

BRIEF DESCRIPTION OF THE DRAWINGS

FIG. 1 is a sectional view of the cup attached to the carpet.

FIG. 6 is a perspective view of a pawl of FIG. 1 in ready position.

FIG. 7 is a perspective view of a pawl of FIG. 5 after being locked by the ball.

FIG. 8 is a sectional view of an embodiment of the cup of the invention using an alternative pawl mechanism.

FIG. 11 is a sectional view taken along line 11—11 of FIG. 10

FIG. 12 is a detail sectional view of the pawl mechanism of FIG. 8 taken along line 12—12.

FIG. 13 is a sectional view taken along line 13—13 of FIG. 12.

DETAILED DESCRIPTION OF PREFERRED EMBODIMENTS

Figure 9:
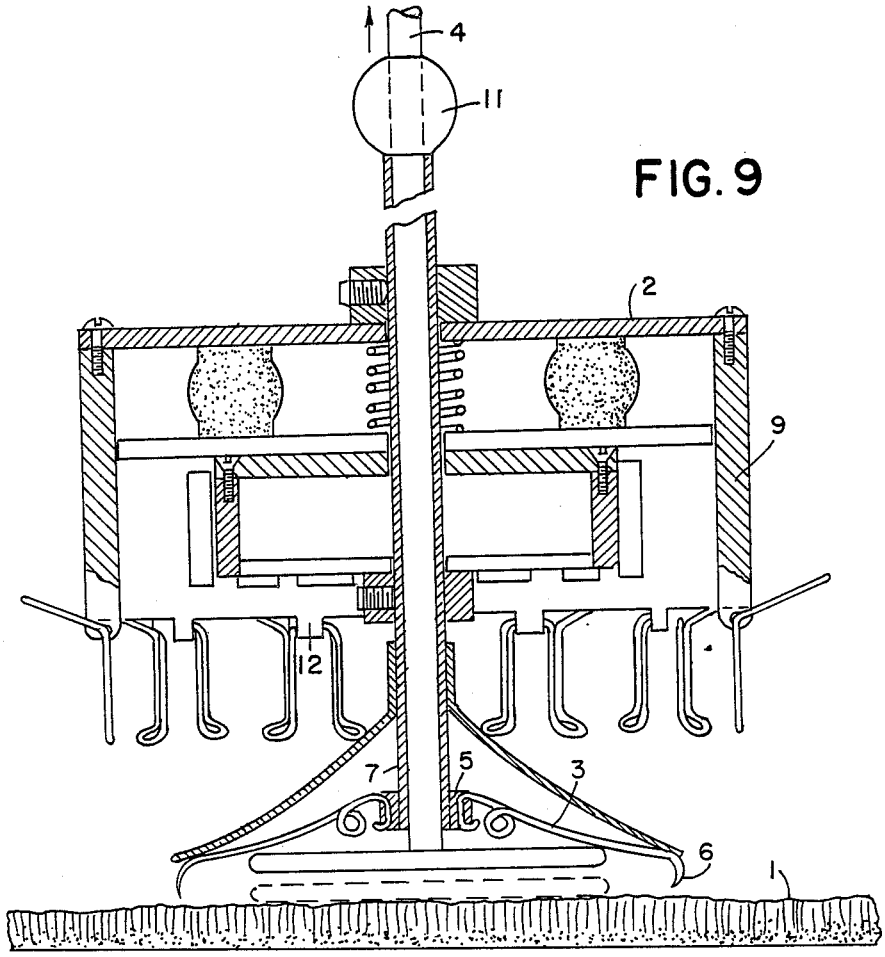
FIG. 9 is a sectional view of the cup showing how mechanism releases unit from the carpet.

Referring now first to FIGS. 1 and 9, showing the simulated grass carpet 1 to which cup 2 may be removably attached at any point by means of the multiple spring wire hooks 3 attached to center sleeve 7 around center post 4 at a first end 5 and directed radially therefrom to terminate in hooked ends 6 that firmly engage carpet 1 when sleeve 7 is forced down. FIG. 1 shows cup 2 secured in place and FIG. 9 shows how cup 2 is released by pulling up center post 4 to which disc 8 is connected while holding sleeve 7 down by ball handle 11. The disc 8 engages the underside of springs 3, forcing the hooked ends 6 out of the carpet without damage.

Referring now to FIGS. 1–7, an inverted cup-shaped housing 9 is attached to sleeve 7 by set scre 10. Projections 12 extending below housing 9 have transverse holes 13 which receive straight portions 14 of wire elements 15. The wire elements 15 pivot freely in transverse holes 12 by these straight portions 14. The force of gravity causes them to assume the "ready" position shown in FIGS. 1, 5 and 6, since leg 16 is longer and heavier then leg 17 of wire element 15. As shown in FIG. 4A, when a ball rolls into the cup 1, it strikes one or more legs 16 of elements 15 when they pivot inwardly as shown. Because leg 17 provides a counterbalance and the element pivots freely, very little kinetic energy is required for the process. As the ball 18 continues inward, leg 16 swings upward toward magnet 19.

Figure 5:
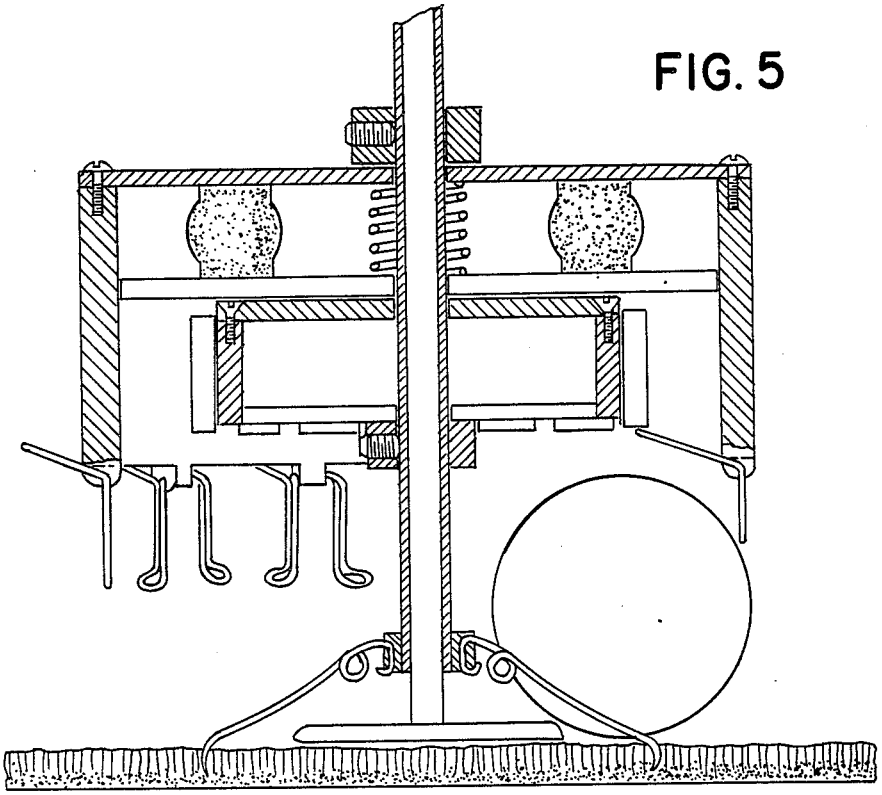
FIG. 5 is a sectional view as in FIG. 4A showing how the ball is locked in the cup.

Because wire element 15 is ferromagnetic, leg 16 is pulled toward it by magnetic force that increases as the inverse square of the distance between. This causes leg 17 to be forced downward behind the ball as shown in FIG. 5. This action traps or locks the ball, preventing it from rolling out of the cup once it has entered a "cup area" that would be equivalent to the area of a true golf hole or cup wherein the ball would drop down into the hole and not roll out. The golfer can remove the ball manually by pulling the wire element off the magnet as he removes the ball.

Spring 20 and resilient ring 21 may be used together with set screw 22 to adjust the level of magnets 19 relative to elements 15 and set screw 10 may be used to adjust the level of elements 15 relative to the surface of carpet 1 for most effective operation.

Figure 10:
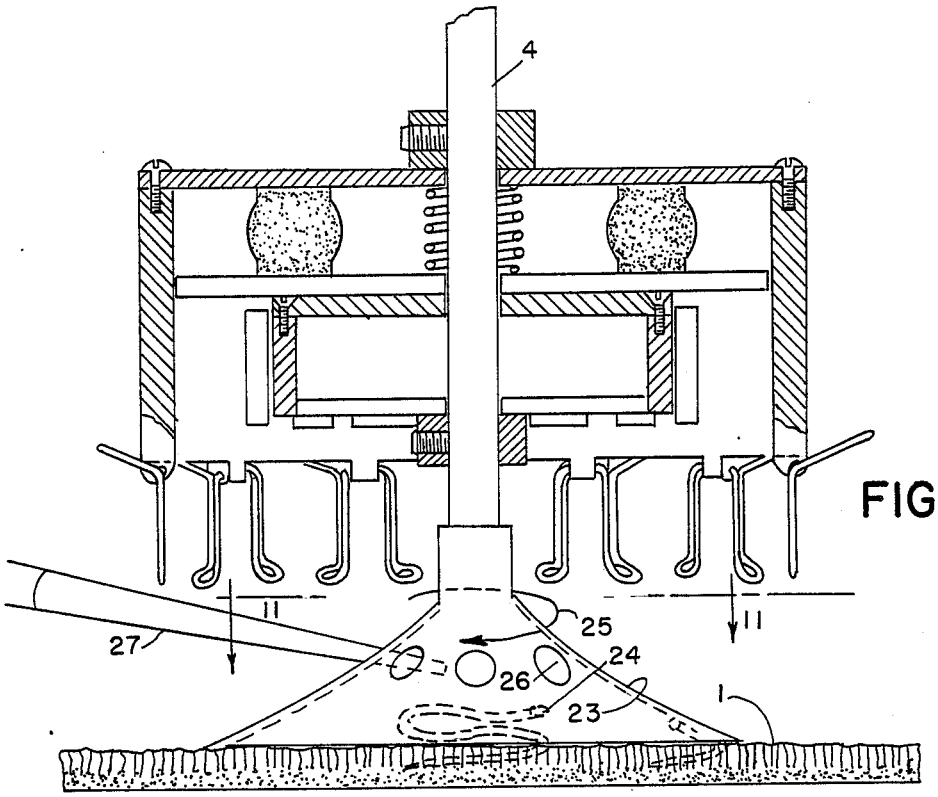
FIG. 10 shows in cross sectional view an alternative carpet attaching mechanism.

FIGS. 10 and 11 illustrate an alternative carpet attaching means in which a cone or disc 23 attached to center post 4 has spring hooks 24 fixedly attached along the underside of its perimeter. These hooks may resemble curtain hooks. Their points are all directed in a single direction in a circle so that when the cone is rotated clockwise, as indicated by arrow 25, hooks 24 engage the carpet and pull the cup firmly against its surface. When the cone is rotated counter clockwise, the cup is disengaged. Apertures 26 in cone 23 enable a tool 27 to turn the cone.

Referring now to FIGS. 8, 12 and 13, an alternative embodiment of the trapping or locking mechanism is illustrated. Bent wire elements 29 are pivotally engaged in transverse holes 32 formed in pivot projections 30. The hole is a part of slot 34 in the end of projection 30 so that element 29 may be preformed and then its straight portion 33 may be simply snapped through the slot and into the hole where it pivots freely inward toward the center post 4 but stop projections 31 prevent outward movement. Alternatively pivot elements 29 may be molded of stiff plastic.

When ball 18 rolls into the cup areas, element 29 moves from its resting downward position, pivotting inward as shown when it contacts the ball. The element continues pivoting inward as the ball advances until it no longer makes contact with the ball, whereupon the element swings back to its original vertical position. The ball cannot roll out at any point because it must first strike a pivoting element 29 which is stopped from the outward movement required to release the ball by stop projections 31. The cup 9 is resting on shoulder 35 held to post 4 by set screw 36. The cup 9 may be lifted off shoulder 35 to retrieve the ball. Set screw 36 may be used to adjust the height of cup 9 for most effective operation.

An alternative embodiment of a means for removably attaching a cup to carpet 1 is shown in FIG. 8 wherein a flat plastic disc 39 is embedded in a recess in the bottom of carpet 1. A threaded hole 40 in disc 39 receives a center post that has a threaded bottom end. When the post is unscrewed, the embedded disc does not interfere with rolling up the carpet.

Also illustrated in FIG. 8 is a means of joining together sections of carpet 1 at a seam 37 with recesses 38 in the underside of the carpet at the edge. A thin tack strip of the type well known in the carpet art may then be used in the recess to make a tight seam without elevations.

Figure 2:
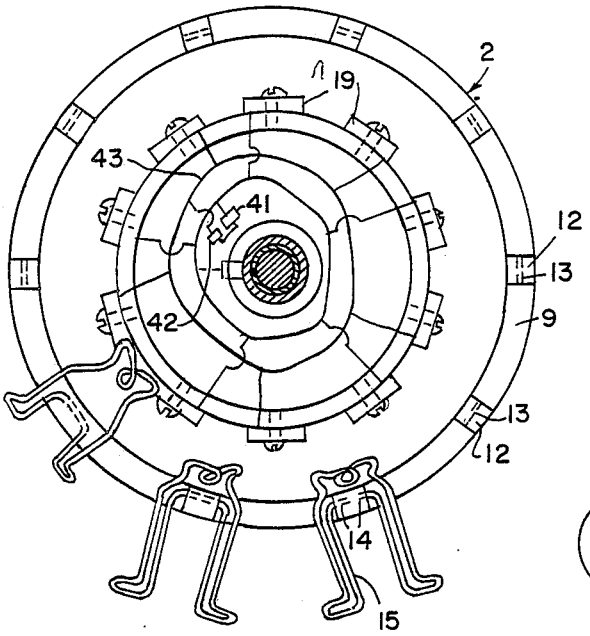
FIG. 2 is a sectional view along the line 2—2 of FIG. 1.
Figure 4B:
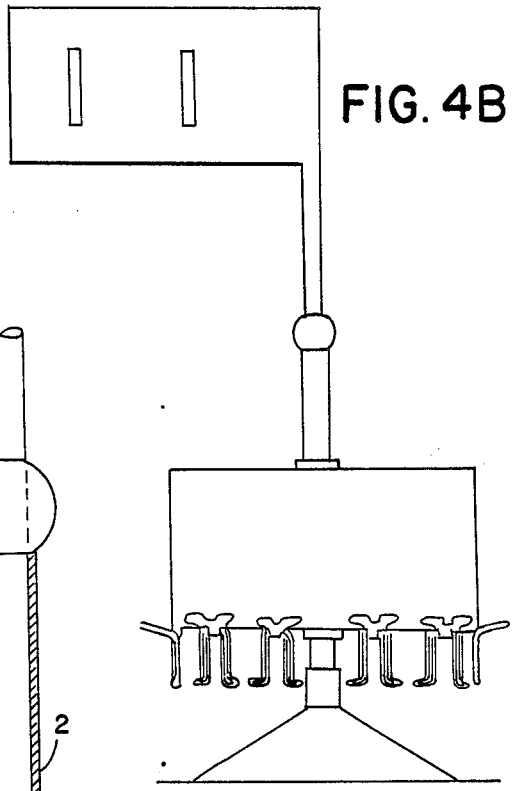
FIG. 4B is a front elevation view of the cup.
Figure 4A:
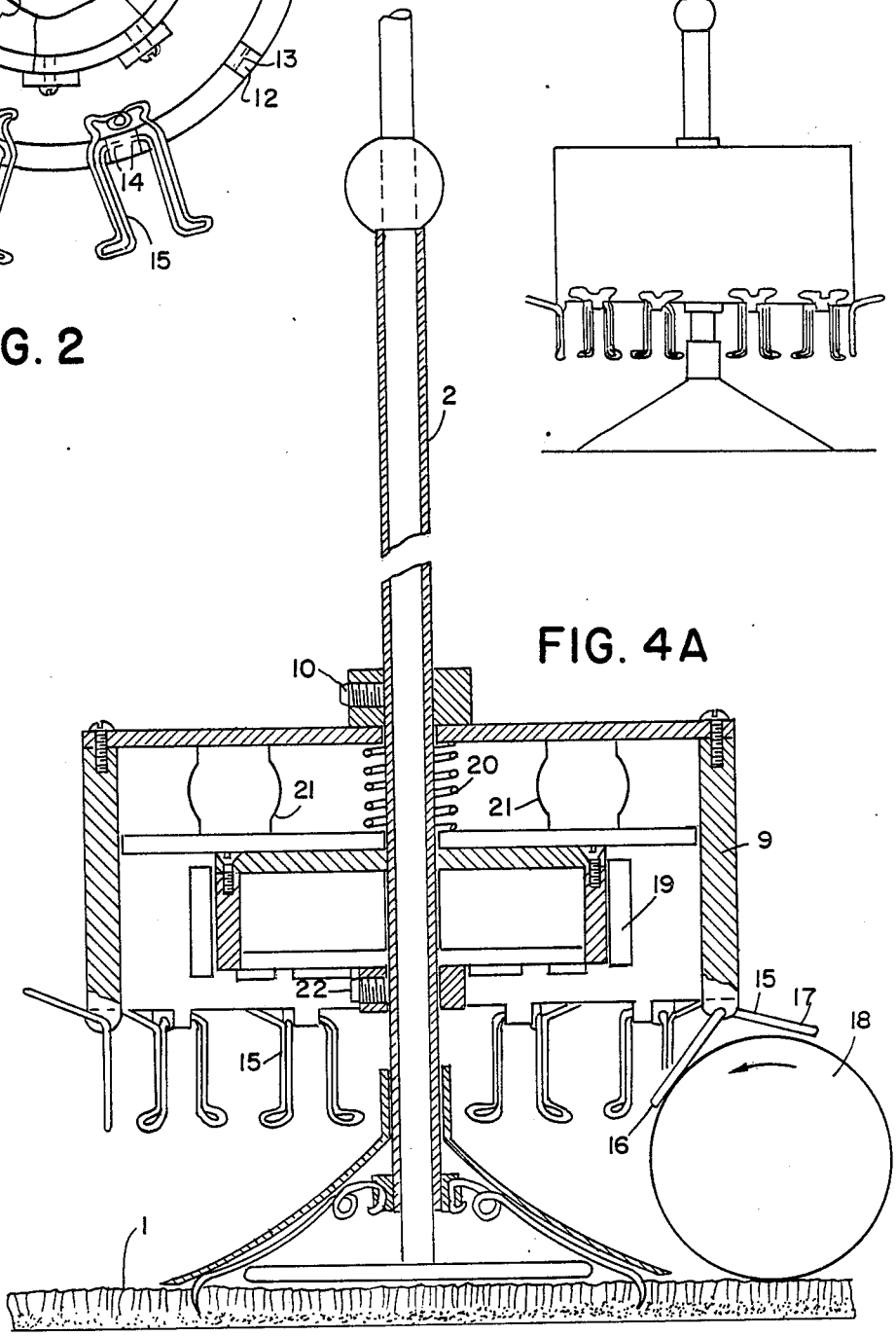
FIG. 4A is a sectional view as in FIG. 1 illustrating the ball entering the cup.
Figure 3:
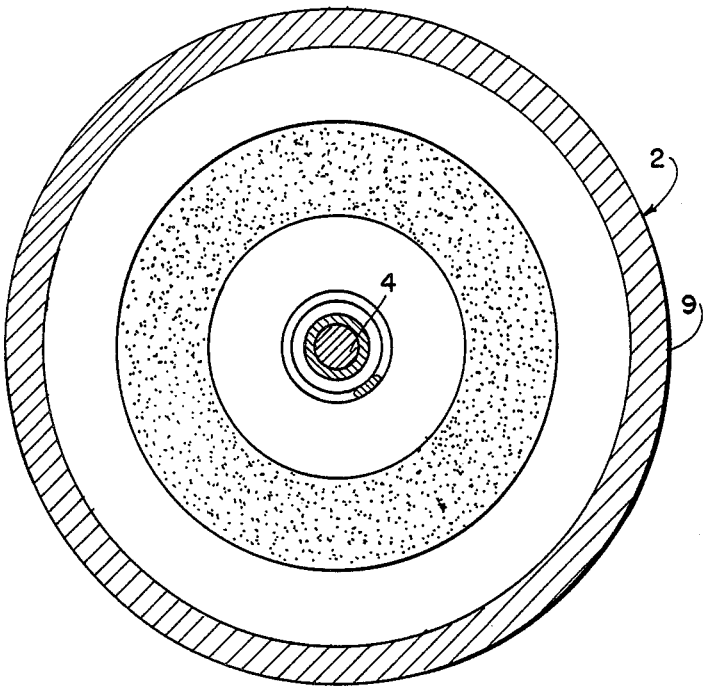
FIG. 3 is a sectional view along the line 3—3 of FIG. 1.

FIG. 2 illustrates diagrammatically an electrical signal means that may be optionally incorporated in cup 2. Every other magnet 19 is wired to a first common wire 43. And the other magnets 19 are wired to a second common wire 44. An electric battery 41 is wired in series with an electric signal device 42 that may be a beeper, a light or a radio transmitter. Also in series are common wires 43 and 44. Only when a wire element 15 is engaged by the magnets 19 are adjoining magnets electrically connected by the wire element, and the circuit completed, electrically indicating that a ball is in the cup.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A golf putting apparatus with a simulated grass surface that can be compactly packaged for transport and storage and readily assembled for play with cup devices that simulate the holes or cups on a golf green that receive and retain a golf ball, the apparatus comprising:

(a) a carpet means simulating the smooth grass surface of a golf green with flat seam joining means;

(b) at least one cup device including retaining means for retaining said ball when it enters a particular area at said device, said cup device extending above the surface of said carpet means and said retaining means suspended from said cup device; and (c) attaching means connected to said cup device, said attaching means removably attaching said cup device to said carpet means.

2. The apparatus according to claim 1, in which said attaching means is connected to said cup device by central vertical pole means.

3. The apparatus according to claim 2, in which said attaching means includes spring nap-engaging elements radially arranged about said pole means.

4. The apparatus according to claim 3, in which said attaching means includes a disengaging element connected to said pole means including moving means for moving said disengaging element against said nap-engaging elements to release them from said carpet means.

5. The apparatus according to claim 2, in which said attaching means includes spring hooks arranged in a circle about said pole means with points of said hooks all pointing in one direction of said circle, said spring hooks adapted for engaging said carpet means when rotated in a first direction and for disengaging from said carpet means when rotated in a second direction.

6. The apparatus according to claim 1, in which said retaining means comprises a plurality of hanging elements pivotally attached to the perimeter of said cup device.

7. The apparatus according to claim 6, in which said hanging elements are free to swing inwardly but are restrained from swinging outwardly by stop means connected to said cup device.

8. The apparatus according to claim 6, in which said hanging elements are constructed of ferromagnetic material and said restraining means further includes magnets that attract said hanging elements when said ball causes said elements to swing inwardly.

9. The apparatus according to claim 1 further comprising electrical signal means connected to said retaining means, said signal means signalling when said ball is retained in said cup device.

10. The apparatus according to claim 1, in which said attaching means includes flat screw fastening members embedded in said carpet means and said pole means has a threaded lower end for threadably engaging and disengaging said fastening member.

11. In a golf putting apparatus with a simulated grass surface that can be compactly packaged for transport and storage and readily assembled for play with cup devices that simulate the holes or cups on a golf green that receive and retain a golf ball, the cup device comprising:

retaining means for retaining said ball when it enters a particular area at said device, said cup device extending above the surface of said carpet means and said retaining means suspended from said cup device; and attaching means connected to said cup device, said attaching means removably attaching said cup device to said carpet means.

12. The apparatus according to claim 11, in which said attaching means is connected to said cup device by central vertical pole means.

13. The apparatus according to claim 12, in which said attaching means includes spring nap-engaging elements radially arranged about said pole means.

14. The apparatus according to claim 13, in which said attaching means includes a disengaging element connected to said pole means including moving means for moving said disengaging element against said nap-engaging elements to release them from said carpet means.

15. The apparatus according to claim 12, in which said attaching means includes flat screw fastening members embedded in said carpet means and said pole means has a threaded lower end for threadably engaging and disengaging said fastening member.

16. The apparatus according to claim 11, in which said retaining means comprises a plurality of hanging elements pivotally attached to the perimeter of said cup device.

17. The apparatus according to claim 16, in which said hanging elements are free to swing inwardly but are restrained from swinging outwardly by stop means connected to said cup device.

18. The apparatus according to claim 16, in which said hanging elements are constructed of ferromagnetic material and said restraining means further includes magnets that attract said hanging elements when said ball causes said elements to swing inwardly.

19. The apparatus according to claim 11 further comprising electrical signal means connected to said retaining means, said signal means signalling when said ball is retained in said cup device.

20. The apparatus according to claim 11, in which said attaching means includes spring hooks arranged in a circle about said pole means with points of said hooks all pointing in one direction of said circle, said spring hooks adapted for engaging the nap of said carpet when rotated in a first direction and for disengaging from said nap when rotated in a second direction.

* * * * *